US007841796B2

(12) United States Patent
Bruggeman et al.

(10) Patent No.: US 7,841,796 B2
(45) Date of Patent: Nov. 30, 2010

(54) PAINT TRIM TOOL WITH ADJUSTABLE VALVE

(75) Inventors: Daniel Bruggeman, Minneapolis, MN (US); Stephen Kohs, Forest Lake, MN (US); Dion M. McDevitt, Ramsey, MN (US)

(73) Assignee: Diversified Dynamics Corporation, Minneapolis, MN (US)

( * ) Notice: Subject to any disclaimer, the term of this patent is extended or adjusted under 35 U.S.C. 154(b) by 1021 days.

(21) Appl. No.: 11/638,739

(22) Filed: Dec. 13, 2006

(65) Prior Publication Data

US 2008/0145137 A1 Jun. 19, 2008

(51) Int. Cl.
*B43K 5/06* (2006.01)

(52) U.S. Cl. ..... 401/181; 401/180; 401/206

(58) Field of Classification Search ..... 401/180, 401/181, 182, 205, 206, 207, 270, 275, 278
See application file for complete search history.

(56) References Cited

U.S. PATENT DOCUMENTS

| | | | | |
|---|---|---|---|---|
| 1,913,466 | A * | 6/1933 | Ackermans | 401/180 |
| 3,231,151 | A * | 1/1966 | Clark et al. | 222/391 |
| 3,971,492 | A * | 7/1976 | Lockwood | 222/146.5 |
| 4,167,349 | A * | 9/1979 | Testa | 401/144 |
| 5,496,123 | A * | 3/1996 | Gaither | 401/176 |

* cited by examiner

*Primary Examiner*—David J Walczak
(74) *Attorney, Agent, or Firm*—Gerald E. Helget; Nelson R. Capes; Briggs and Morgan, P.A.

(57) ABSTRACT

A hand-held trim painting tool consists of a cylindrical body holding paint to be dispensed in a reservoir within the cylindrical body, a head attached to the body, a removable paint applicator attached to the head, a mechanism for loading paint into the reservoir, a valve permitting paint to be dispensed from the reservoir, an actuator incrementally opening and closing the valve, and a dispensing rate adjuster to regulate the rate at which paint is dispensed.

9 Claims, 6 Drawing Sheets

PAINT TRIM TOOL WITH ADJUSTABLE VALVE

BACKGROUND OF THE INVENTION

The present application relates to a hand-held paint trim tool with a dispensing rate adjusting mechanism.

Paint trim tools usually have a relatively small applicator onto which paint is fed, under pressure, from a cylindrical body to which the applicator is attached. Paint is fed from the tube by suitably opening a valve, letting the paint flow onto the applicator. However, previous devices generally have no way to adequately regulate the rate at which paint is dispensed from the valve to the applicator.

The present invention addresses the above problem by providing a paint trim tool with a mechanism that can be adjusted to provide various rates of dispensing the paint.

SUMMARY OF THE INVENTION

A hand-held trim painting tool consists of a cylindrical body holding paint to be dispensed in a reservoir within the cylindrical body, a head attached to the body, a removable paint applicator attached to the head, a mechanism for loading paint into the reservoir, a valve permitting paint to be dispensed from the reservoir, an actuator incrementally opening and closing the valve, and a dispensing rate adjuster to regulate the rate at which paint is dispensed.

A principle object and advantage of the present invention is that it provides a mechanism for regulating the rate at which paint is dispensed from the valve to the applicator.

DETAILED DESCRIPTION OF THE PREFERRED EMBODIMENT

Figure 1:
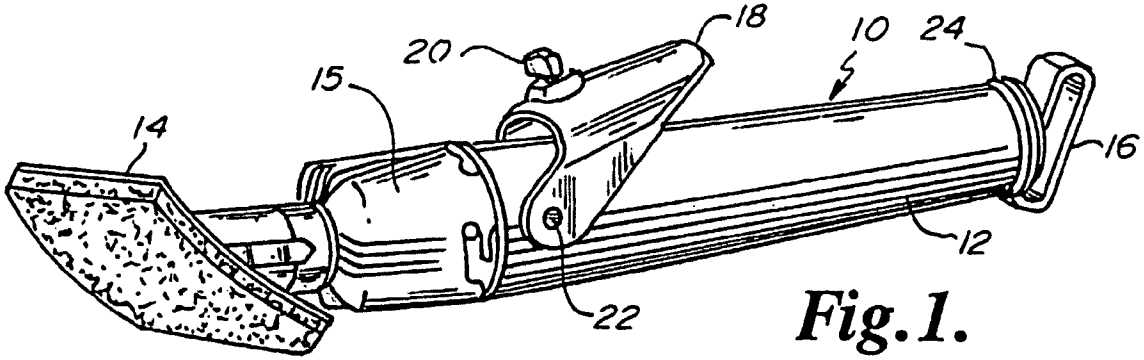
FIG. 1 is a perspective view of the present invention.

The present invention is generally referred to in the Figures as reference numeral 10.

FIGS. 1, 2, 3, and 7 show general operating parts of the invention.

Figure 2:
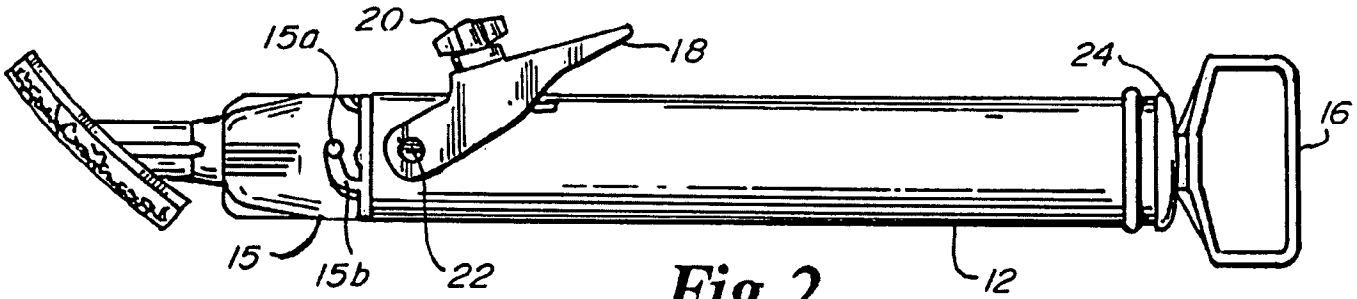
FIG. 2 is a side view of the present invention.

As shown in FIGS. 1 and 2, the present invention comprises a paint trim tool 10, which preferably further comprises a body 12 holding paint; an applicator 14 upon which paint is dispensed from the body 12; a head 15 holding the applicator 14, the head 15 being suitably removably attached to the body 12 as for example by a pin 15*a* on the body slidably engaging a groove, slot, or channel 15*b* on the head 15; a nozzle 32 (FIG. 3); a handle 16; a trigger 18; a trigger pivot 22; and an end cap 24.

Figure 7:
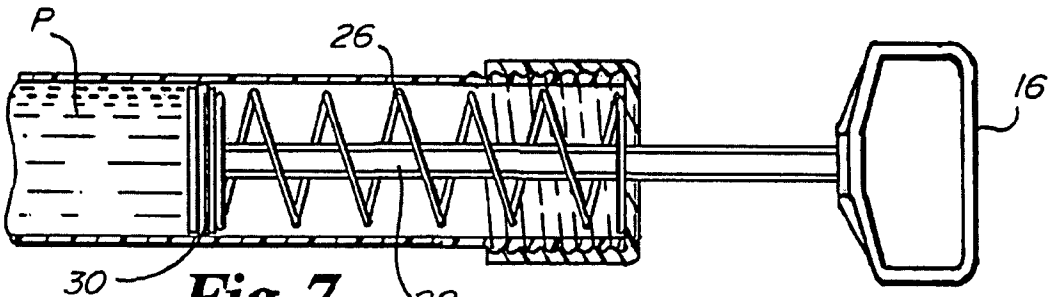
FIG. 7 is a detailed cross-section of the mechanism for drawing paint into the reservoir and applying pressure to the paint within the reservoir.

FIG. 7 shows some additional internal structure of the invention 10, which preferably comprises a handle spring 26, a handle plunger 28, and a handle plunger O-ring 30.

Several embodiments of the invention are discussed below, but the common operation is as follows. Paint may be drawn into the body 12 (with the applicator removed) through the head 15, by drawing back on the handle 16 and operating the trigger 18 to open the valve (discussed below). Drawing back on the handle 16 also compresses the handle spring 26. When enough paint has been drawn into the body 12, the operator releases the trigger 18 and the handle 16. The handle spring 26 develops pressure against the paint P through the handle plunger 28 reciprocating through the handle plunger O-ring 30. Because the valve (discussed below) is now closed, paint cannot escape from the body. The head 15 with nozzle 32 is then re-attached to the body 12.

To dispense paint, the valve (discussed below) is opened by pressing the trigger 18, and paint, urged by the handle spring 26 and the handle plunger 28, then flows to the applicator 14 through the channel 34 and the nozzle 32.

Figure 3:
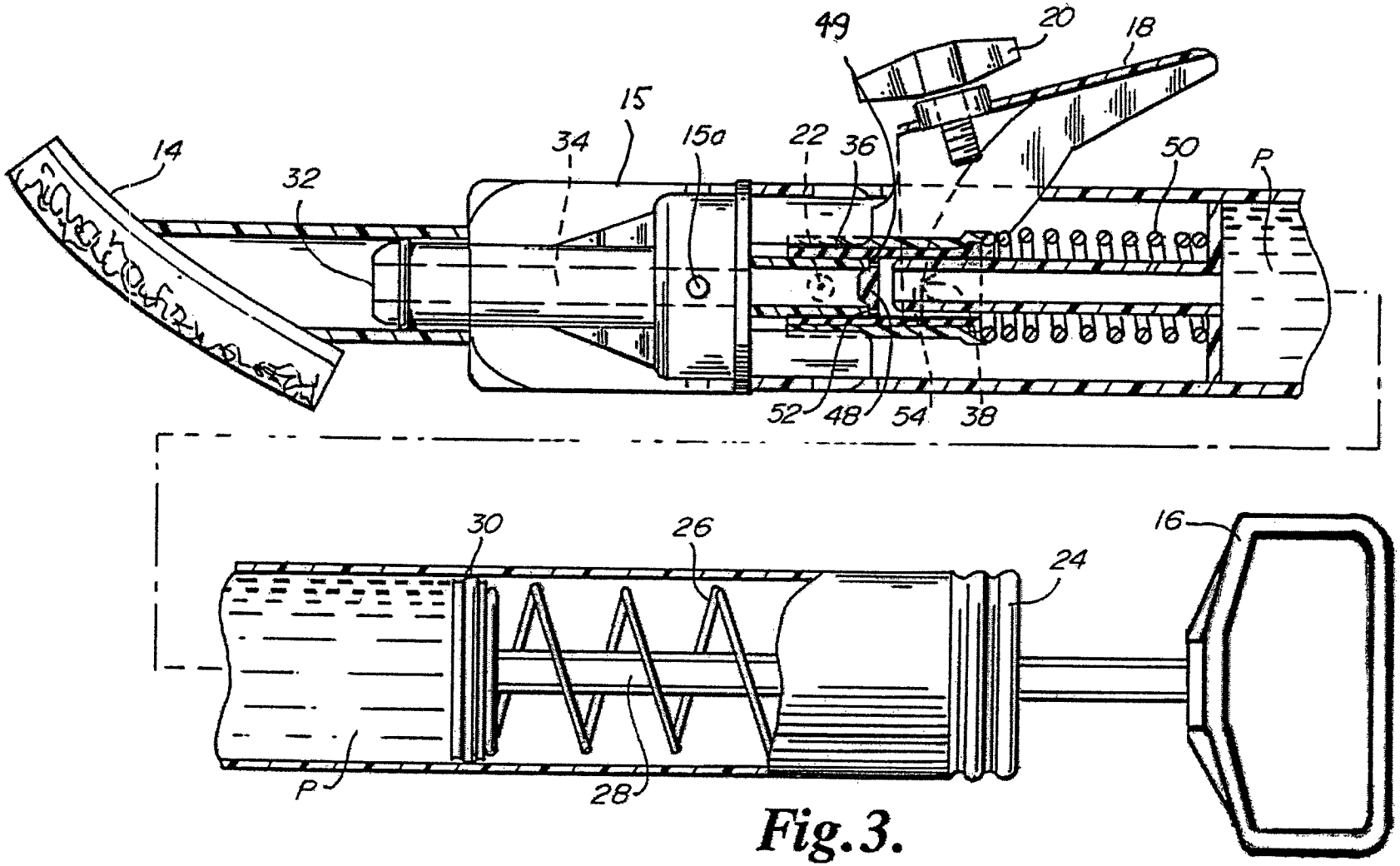
FIG. 3 is an exploded view of the present invention.

FIG. 3 is a partially broken away enlarged view of the paint trim tool 10.

Figures 6, 8, 9, 10:
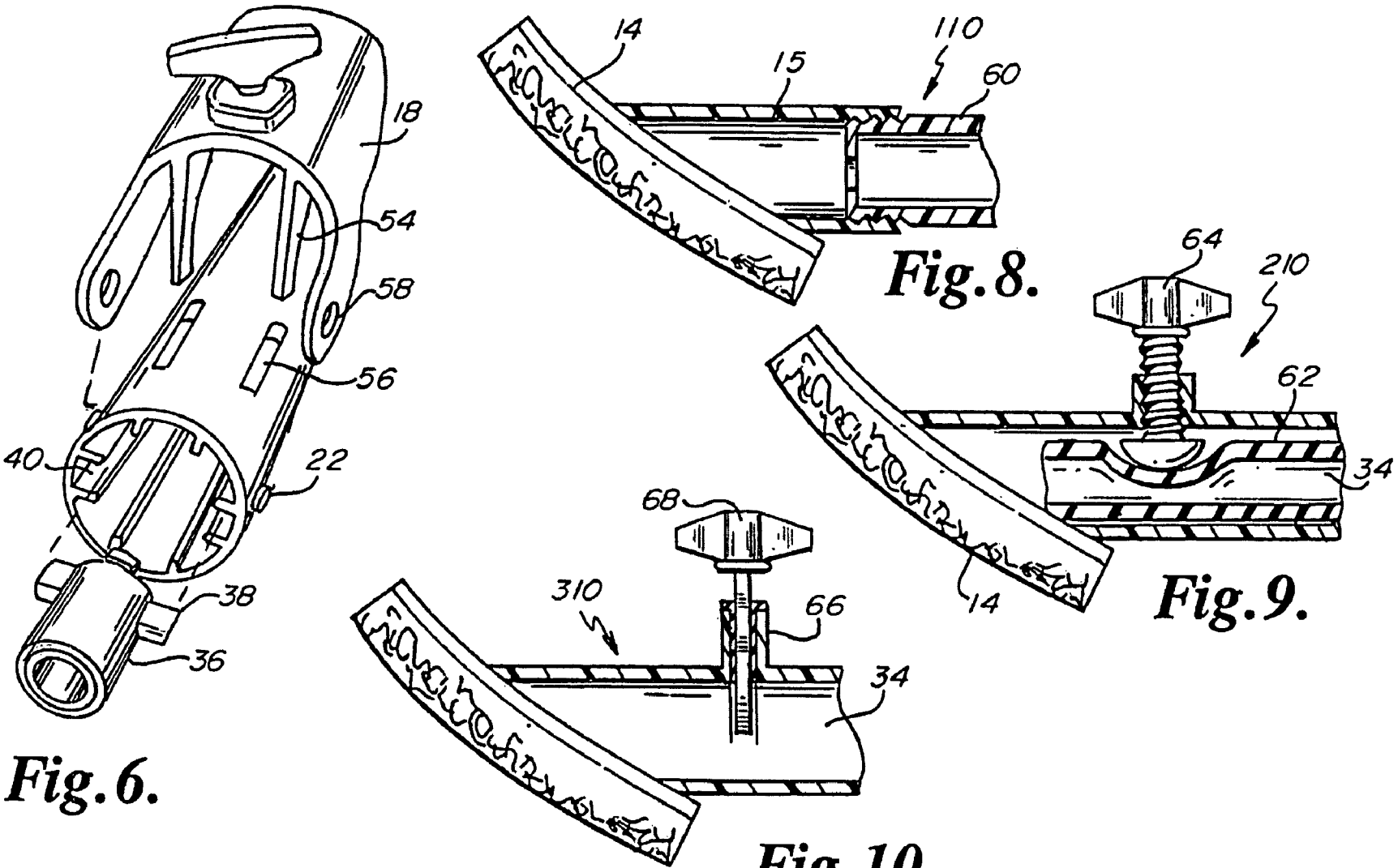
FIG. 6 is a perspective view showing the way that various parts of the invention are put together.
FIG. 8 is a cross-section illustrating a second embodiment of the present invention.
FIG. 9 is a cross-section illustrating a third embodiment of the present invention.
FIG. 10 is a cross-section illustrating a fourth embodiment of the present invention.
Figure 6A:
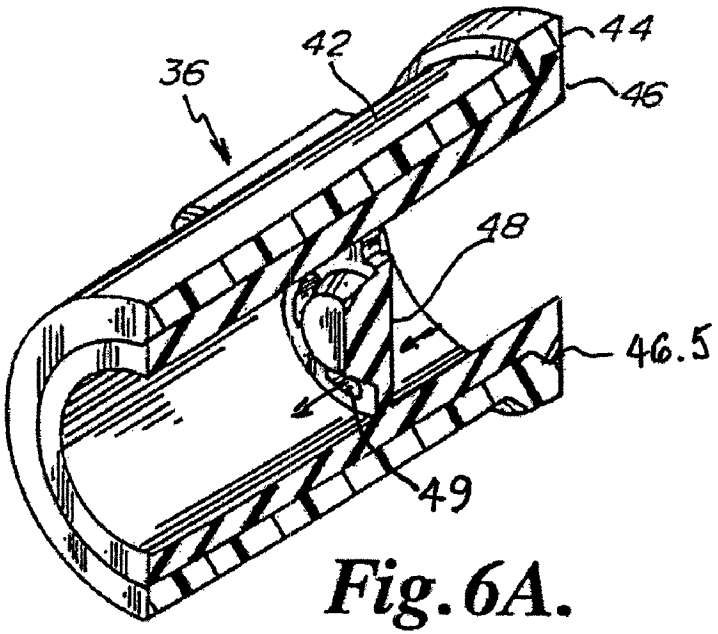

The present invention further comprises a valve body 36 which mounts within the body 12 by ears 38 sliding in slots or grooves 40, as best seen in FIG. 6. FIG. 6A is a detailed cross-section of the valve body 36. As can be seen, the valve body preferably comprises an outer hard shell 42, with a flange 44. A rubber-like inner shell 46 is fixedly mounted to the outer hard shell 42, as for example by adhesive, and engages the flange 44 with a protrusion 46.5. A bullet valve 48 with paint passages 49 therethrough is fixedly mounted to the inner shell 46. The valve body 36 slides in the slots of grooves 40 in the body 12, doing so when activated by the trigger 18.

The valve body 36 is urged forwardly by a valve spring 50, thus urging the bullet valve 48 against a valve seat 52 sealing valve passages 49. In this position, paint cannot flow out of the body 12 onto the applicator 14.

The trigger 18 further comprises trigger arms 54 which enter the body 12 through trigger slots 56, as best seen in FIG. 6. The trigger arms 54 are curved and increase in width toward the trigger 18. The trigger 18 has pivot apertures 58 which engage the trigger pivots 22. The trigger arms 54 slidably engage the ears 38, causing the valve body 36 to move away from the valve seat 52, allowing paint to flow through valve passages 49 (arrows in FIG. 6A) into the channel 34 and thence through the nozzle 32 to the applicator 14. As shown in FIG. 3, in the static condition, the arms 54 rest against the ears 38 so that the bullet valve 48 is urged by the trigger spring 50 against the valve seat 52.

Figure 4:
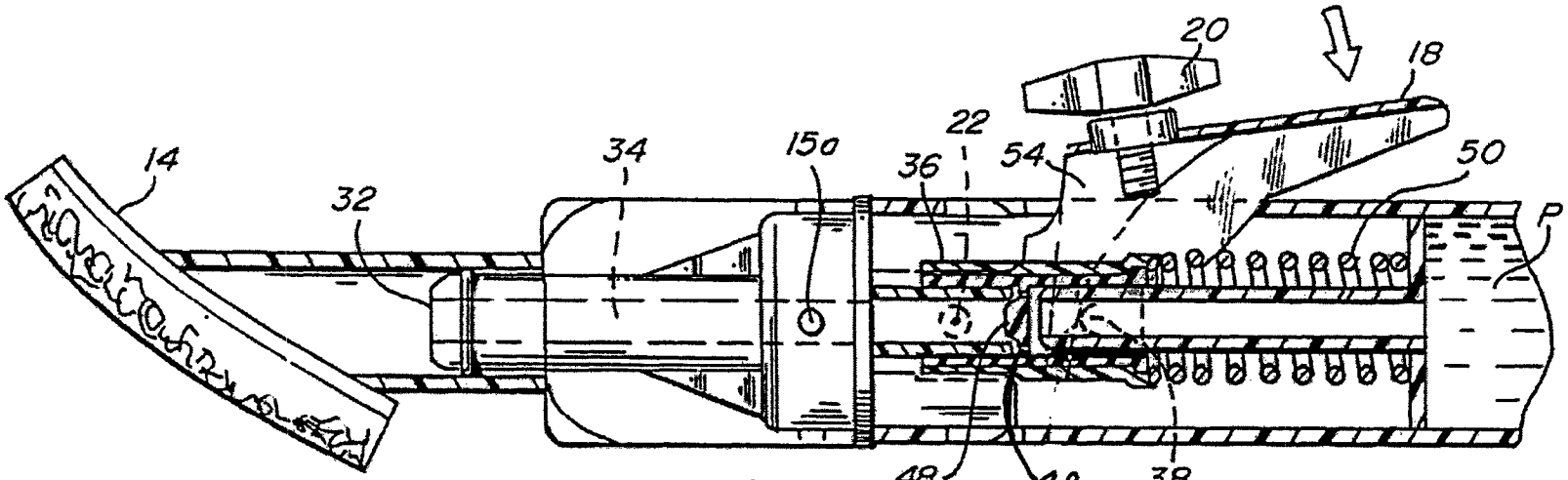
FIGS. 4 and 5 are side views of the present invention with some structure cut away to show details of the dispensing mechanism.

In FIG. 4, the trigger 18 has been depressed as shown by the arrow. This causes the trigger arms 54 to ride against the ears 38, with the ears 38 rising along the curved, widening arms. As the ears rise along the widening arms, this in turn causes the valve body 36, attached to the ears 38, to move rearwardly, so that the bullet valve 48 moves slightly off the valve seat 52, allowing paint to flow through passages 49 into the channel 34 at a slow rate.

In the first embodiment, it will be seen that a trigger adjustment screw 20 has been screwed into the trigger 18 so that the trigger adjustment screw 20 impinges the body 12, stopping the inward motion of the trigger arms and the rearward motion of the bullet valve, regulating the rate of dispensing paint.

Figure 5:
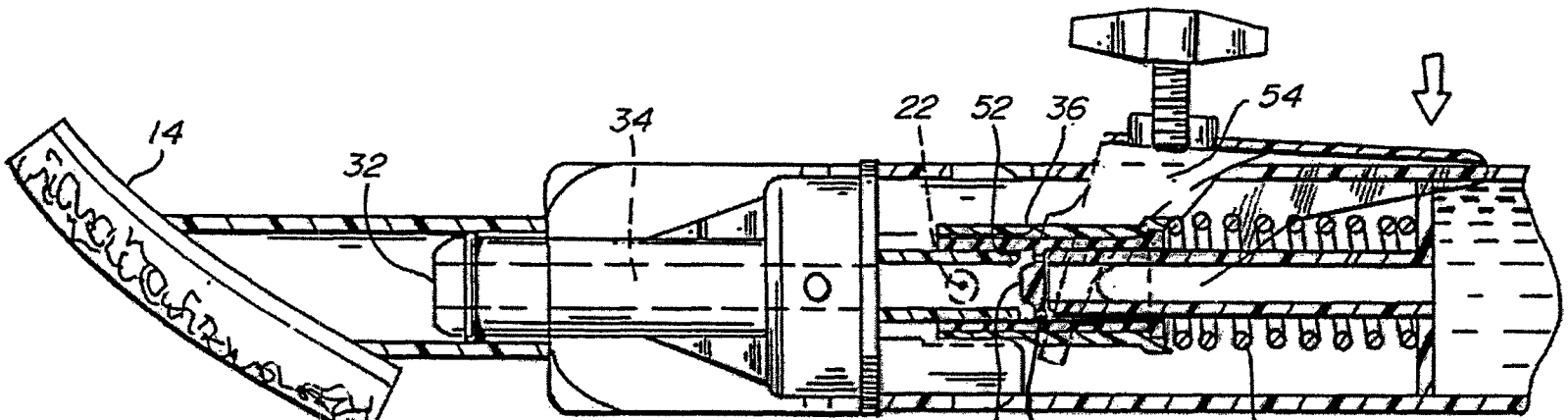

In FIG. 5, the trigger adjustment screw 20 has been screwed out of the trigger 18, allowing the trigger 18 to be depressed further, again as shown by the arrow. The curved, widened portion arms 54 have now ridden further along the ears 38, causing the ears 38 to move further rearwardly, so that the bullet valve 48 has moved further away from the valve seat 52, allowing paint to be dispensed at a greater rate.

It will be understood that the trigger adjustment screw can be incrementally screwed in or out of the trigger 18, to increase or decrease the rate of dispensing paint, respectively.

A second embodiment of the present invention 110 is illustrated in FIG. 8. Instead of the trigger adjustment screw, a narrow orifice 60 with external threads has been screwed into the head 15, which has been modified to have internal threads. Because the internal diameter of the orifice 60 is less than that of the head 15, the rate of dispensing paint will be limited. It will be understood that other types of orifices with varying internal diameters may be threaded into the head 15 to regulate the rate of dispensing paint. It will also be understood that the orifice 60 may be inserted at any point along the path of the paint, for example in the channel 34.

A third embodiment of the present invention 210 is illustrated in FIG. 9. Instead of having the adjustment screw 20, a portion of the channel 34 has been modified to a flexible tube 62. An adjustment screw 64 impinges on the flexible tube 62 to control the rate of dispensing paint. It will be understood that the adjustment screw 64 may be incrementally adjusted to incrementally regulate the rate of dispensing paint.

A fourth embodiment of the present invention 310 is illustrated in FIG. 10. Instead of having the trigger adjustment screw 20, at some point along the channel 34, a gate valve 66 has been inserted. The gate valve 66 has an O-ring 68 through which a plunger 68 is slid into and out of the channel 34 to regulate the rate of dispensing paint.

Figure 12:
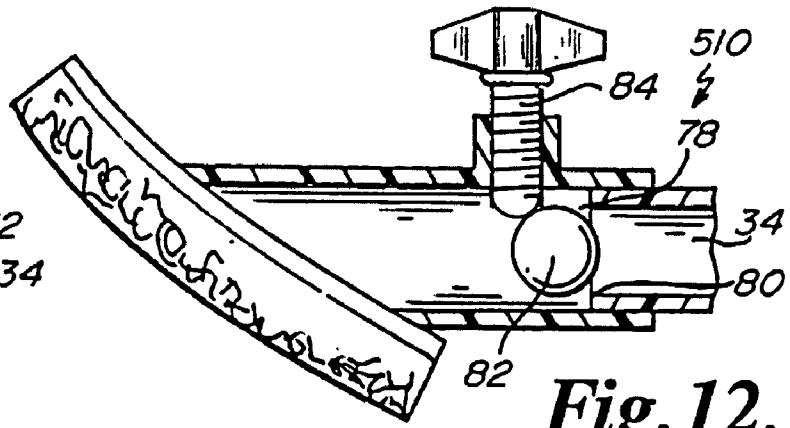
FIG. 12 is a cross-section illustrating a sixth embodiment of the present invention.
Figure 11:
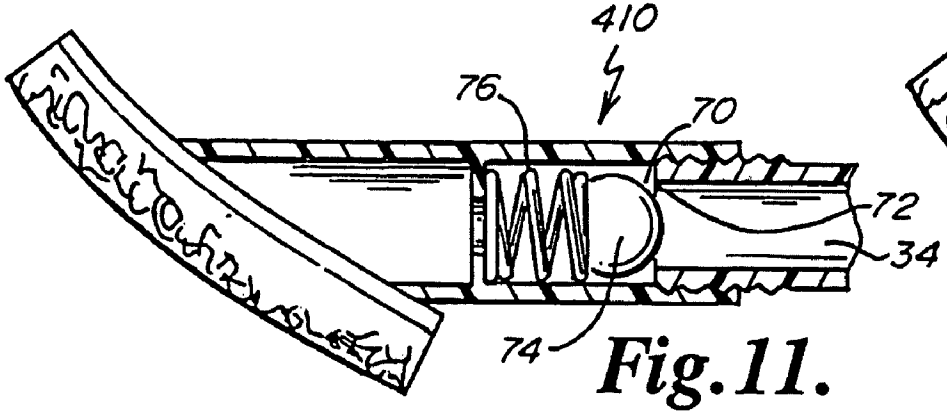
FIG. 11 is a cross-section illustrating a fifth embodiment of the present invention.

A fifth embodiment of the present invention 410 is illustrated in FIG. 11. Instead of having the trigger adjustment screw 20, at some point along the channel 34, a ball valve 70 is inserted. The ball valve 70 further comprises a valve seat 72, a ball 74, and a valve spring 76. The valve seat 72 has external threads which mesh with internal threads on the body 12. The valve seat 72 may be screwed toward or away from the ball, thus increasing or decreasing the tension of the spring 76, respectively. The change in spring tension regulates the rate of dispensing paint A sixth embodiment of the present invention 510 is illustrated in FIG. 12. This embodiment is similar to that of FIG. 11. A ball valve 78 is inserted at some point along the channel 34. The ball valve 78 further comprises a valve seat 80, a ball 82, and an adjustment screw 84. As the adjustment screw 84 is screwed inwardly or outwardly toward the channel 34, the range of motion of the ball 82 is decreased or increased, respectively. The change in the range of motion of the ball regulates the rate of dispensing paint.

Figure 13B:
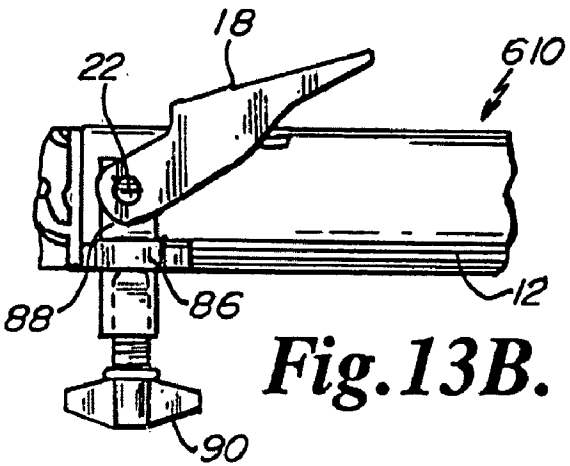
FIGS. 13*a*-13*b* are side views illustrating a seventh embodiment of the present invention.
Figure 13A:
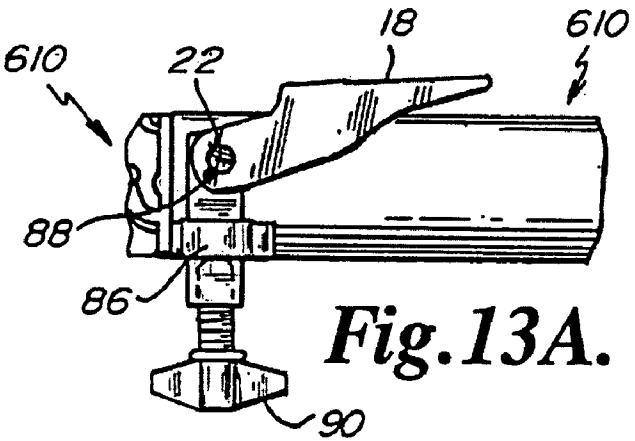
Figure 13C:
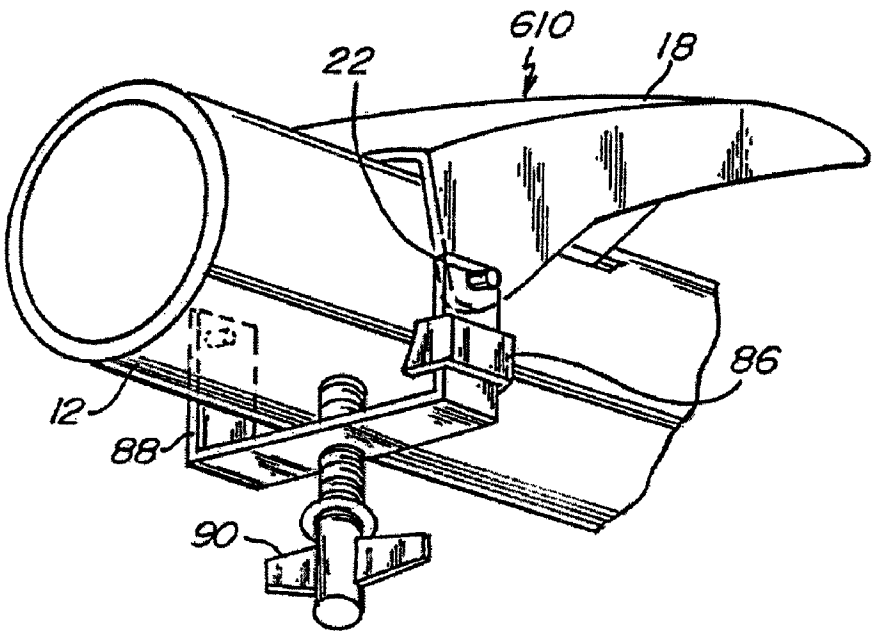
FIG. 13C is a perspective view illustrating the seventh embodiment of the present invention.

A seventh embodiment of the present invention 610 is illustrated in FIGS. 13*a*-13*c*. The invention 510 further comprises a bracket 86 attached to the body 12, a U-channel 88 attached to the trigger pivot 22 and slidingly engaging the bracket, and an adjustment bolt 90 threaded into the U-channel 88 and impinging on the body 12. As the adjustment bolt is tightened, it causes the U-channel 88 to move downwardly within the bracket 90. Because the trigger pivots 22 are attached to the U-channel 88, the trigger pivots 22 also move downwardly relative to the tube 12. This in turn causes the trigger 18 to pivot to a position further from the tube 12, giving the trigger 18 a greater range of motion relative to the body 12. This permits the trigger arms 54 to move further into the body 12 when the trigger 18 is depressed, which in turn allows a greater dispensing rate as the trigger arms act on the valve body 36, as previously described. Compare FIG. 13*a* to FIG. 13*b*.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A hand-held trim painting tool, comprising:

(a) a cylindrical body including a removable head with a nozzle at one end of the body and a cap at the other end of the body;

(b) a paint reservoir within the cylindrical body adapted to receive and store paint;

(c) an external handle slidably mounted in the cap connected to a biased plunger within the reservoir to draw paint into the reservoir through the nozzle and to pressurize the paint within the reservoir;

(d) a valve permitting paint to be dispensed from the paint reservoir to the nozzle;

(e) a trigger opening and closing the valve, wherein the trigger pivots upon the cylindrical body and wherein the trigger further comprises at least one arm sliding into and out of the body acting upon the valve to incrementally open the valve as the arm slides further into the body and the dispensing rate adjuster adjusts the distance in which the arm slides into the body to regulate the rate at which paint is dispensed from the valve to the applicator;

(f) an applicator attached to the head for receiving and dispensing paint from the reservoir through the nozzle; and (h) a dispensing rate adjuster to regulate the rate at which paint is dispensed from the valve to the applicator.

2. The tool of claim 1, wherein the dispensing rate adjuster comprises a screw threaded into the lever and impinging upon the body, thereby adjusting the travel of the lever arms into the body.

3. The tool of claim 1, wherein the dispensing rate adjuster comprises a plurality of interchangeable orifices of varying internal diameter removably mounted between the reservoir and the applicator.

4. The tool of claim 1, wherein the dispensing rate adjuster comprises an adjustment screw threaded into the body and a flexible tube receiving paint from the reservoir, the adjustment screw impinging upon the flexible tube to incrementally open and close the flexible tube.

5. The tool of claim 1, wherein the dispensing rate adjuster comprises a gate valve mounted on the body, the gate valve further comprising an O-ring and a plunger sliding through the O-ring into the body to incrementally adjust the flow of paint through the body.

6. The tool of claim 1, wherein the dispensing rate adjuster comprises a ball valve in the body between the paint reservoir and the applicator, the ball valve having a ball, a valve seat, and a spring urging the ball against the valve seat, and wherein the valve seat may be incrementally moved toward or away from the spring, thus varying the spring tension urging the ball against the valve seat.

7. The tool of claim 1, wherein the dispensing rate adjuster comprises a ball valve in the body between the paint reservoir and the adaptor, the ball valve having a ball, a valve seat, and an adjustment screw threadably engaging the body and impinging upon the ball, thereby changing the range of motion of the ball away from the valve seat.

8. The tool of claim 1, wherein the dispensing rate adjuster comprises a bracket attached to the body, a U-channel slidingly engaging the bracket, and an adjustment bolt threaded into the U-channel and impinging on the body, and wherein the trigger pivots are attached to the U-channel, wherein screwing or unscrewing the adjustment bolt changes the range of motion of the trigger 18 relative to the body 12.

9. A hand-held trim painting tool, comprising:

(a) a cylindrical body including a removable head with a nozzle at one end of the body and a cap at the other end of the body;

(b) a paint reservoir within the cylindrical body adapted to receive and store paint;

(c) an external handle slidably mounted in the cap connected to a biased plunger within the reservoir to draw paint into the reservoir through the nozzle and to pressurize the paint within the reservoir;

(d) a valve permitting paint to be dispensed from the paint reservoir to the nozzle;

(e) a trigger for opening and closing the valve, wherein the trigger comprises a lever pivoting upon the cylindrical body, the lever having arms sliding into and out of the body, the arms acting upon the valve to incrementally open the valve as the arms slide further into the body;

(f) an applicator attached to the head for receiving and dispensing paint from the reservoir through the nozzle; and (g) a dispensing rate adjuster for regulating the rate at which paint is dispensed from the valve to the applicator.

* * * * *